United States Patent [19]

Miller

[11] Patent Number: 4,642,551

[45] Date of Patent: Feb. 10, 1987

[54] CURRENT TO VOLTAGE CONVERTER CIRCUIT

[75] Inventor: Ira Miller, Tempe, Ariz.

[73] Assignee: Motorola, Inc., Schaumburg, Ill.

[21] Appl. No.: 790,026

[22] Filed: Oct. 22, 1985

[51] Int. Cl.[4] ..... G05F 3/20

[52] U.S. Cl. ..... 323/314; 330/257

[58] Field of Search ..... 323/315, 316, 313, 314; 330/257, 288

[56] References Cited

U.S. PATENT DOCUMENTS 3,914,683 10/1975 van de Plassche ..... 323/316

FOREIGN PATENT DOCUMENTS 85108 5/1984 Japan ..... 330/257

*Primary Examiner*—Peter S. Wong
*Assistant Examiner*—Judson H. Jones
*Attorney, Agent, or Firm*—Michael D. Bingham

[57] ABSTRACT

A conversion circuit for providing an output voltage that is proportional to an applied current input. The conversion circuit comprises a current mirror which sinks a current at an output the magnitude of which varies directly with the current input that is applied thereto and a feedback amplifier coupled with the current mirror which provides a feedback current thereto the magnitude of which varies as a function of the current sank at the output of the current mirror whereby an output voltage is established at an output of the feedback amplifier.

8 Claims, 3 Drawing Figures

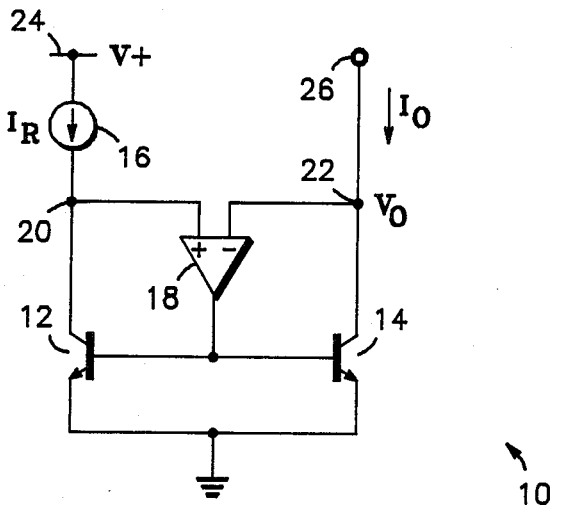
FIG. 1
FIG. 2
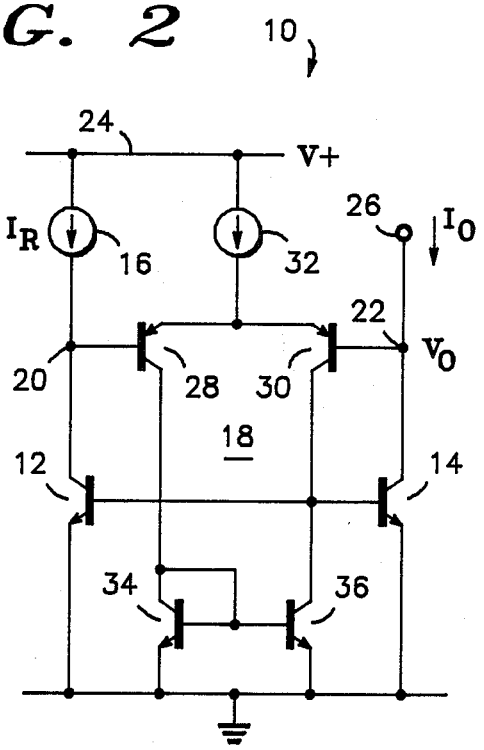

CURRENT TO VOLTAGE CONVERTER CIRCUIT

BACKGROUND OF THE INVENTION

The present invention relates to converter circuits and, more particularly, to a circuit for producing an output voltage that is representative of an applied current input There are a myriad of uses for a current to voltage conversion circuit wherein an output voltage is produced that has a known relationship to a current input signal. For example, a digital to analog converter (DAC) may be realized utilizing such a conversion circuit. Thus, a digital input code consisting of a plurality of discrete current inputs can be converted into a representative analog output voltage.

Such a conversion circuit requires an accurate current mirror in conjunction with other circuitry for accurately converting the applied current input into the output voltage. Hence, a need exists for a current to voltage integrated conversion circuit including a precision current mirror in conjunction with feedback circuitry for producing an output voltage having a known relationship to an applied current input signal.

SUMMARY OF THE INVENTION

Accordingly, it is an object of the present invention to provide an improved current to voltage converter circuit.

It is another object of the present invention to provide an improved current to voltage converter circuit in which a current input is converted to a voltage output that has a magnitude proportional to a resistor ratio.

Still another object of the present invention is to provide a current to voltage conversion circuit suitable to be manufactured in integrated circuit form in which an output voltage is produced that is proportional to a known resistor ratio in response to an applied current input.

In accordance with the above and other objects there is provided a current to voltage converter comprising a precision current mirror for sinking a current at an output thereof that is proportional to an applied current input and feedback amplifier circuitry coupled with the current mirror which produces a voltage output signal as well as a current feedback signal to the current mirror wherein the magnitude of the voltage output signal is proportional to a resistor ratio.

BRIEF DESCRIPTION OF THE DRAWINGS

FIG. 1 is a partial block and schematic diagram illustrating a current mirror circuit utilized in the conversion circuit of the present invention;

FIG. 2 is a detailed schematic diagram illustrating the current mirror of FIG. 1.

DETAILED DESCRIPTION OF THE PREFERRED EMBODIMENT

Figure 3:
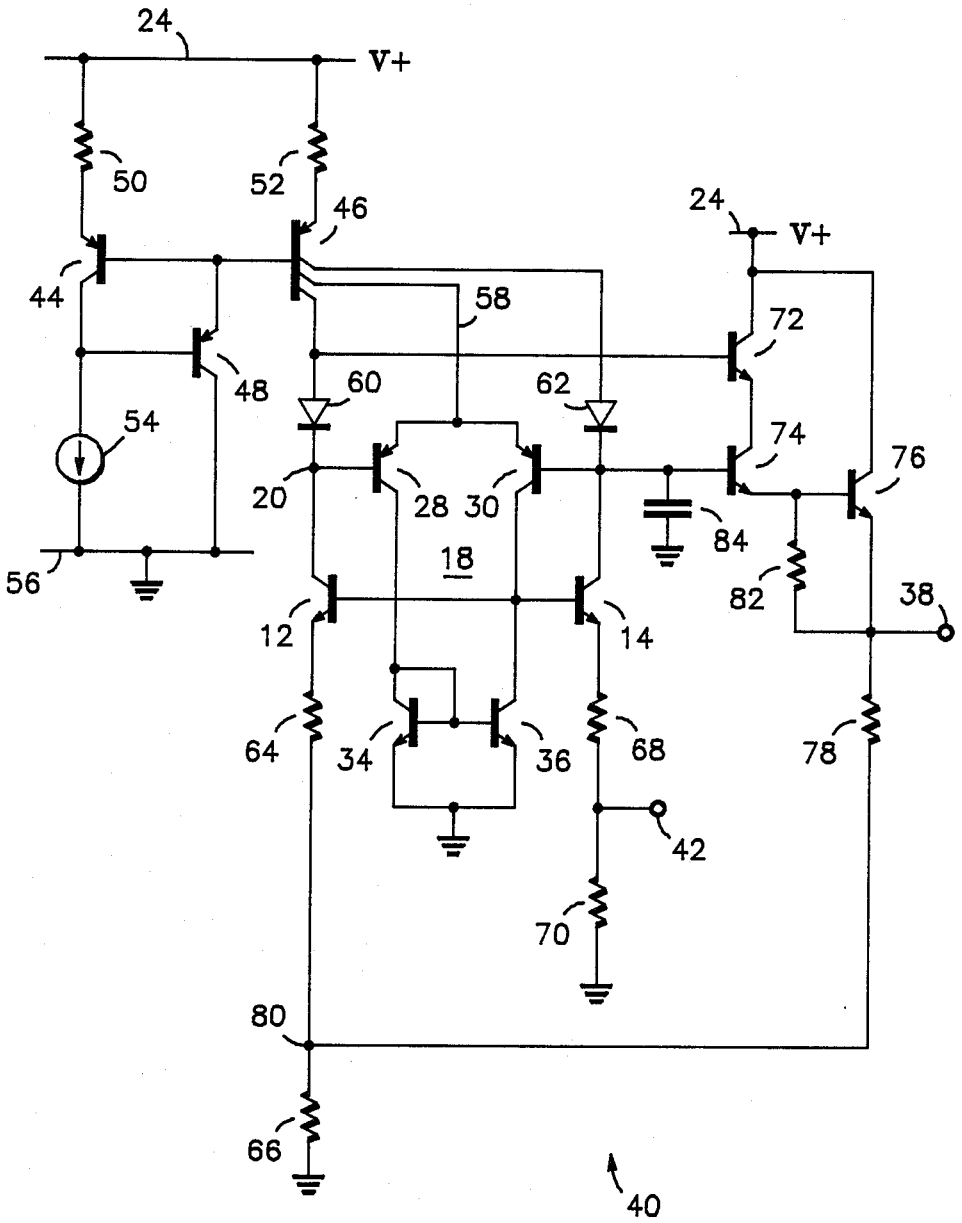
FIG. 3 is a schematic diagram of the current to voltage converter circuit of the present invention.

Turning to FIG. 1 there is shown a block diagram of a precision current mirror 10 that is utilized in the conversion circuit of the present invention. Current mirror 10 is suited to be manufactured in integrated circuit form and can be fabricated using present day low voltage integrated circuit fabrication processes. Current mirror 10 includes a pair of matched, i.e., equal emitter area transistors 12 and 14 which have their base or control electrodes coupled together. The emitters or first electrodes of the transistors are returned to ground reference. The collector or second electrode of transistor 12 is coupled both to reference current source 16 and the non-inverting input of differential amplifier 18 at node 20. Reference current source 16, which is coupled to power supply conductor 24 at which is supplied a source of DC operating potential, sources a reference current $I_R$ to the collector of transistor 12. The inverting input of differential amplifier 18 is coupled to the collector of transistor 14 at node 22 at which an output current $I_O$ is sunk. The output of amplifier 18 is coupled to the bases of transistors 12 and 14. The output of current mirror 10 is taken at output terminal 26.

In operation, output 26 is coupled to some load circuitry (not shown) such that the current $I_o$ is sourced from node 22 which establishes the voltage $V_O$ thereat. Differential or operational amplifier 18 forces the voltage developed at node 20 to be substantially equal in value to the voltage $V_O$ while providing base current drive at the output thereof to transistors 12 and 14. A quiescent operating balanced state is established when transistor 12 is supplied sufficient base drive to enable it to sink substantially all of the current supplied from current reference 16. Since transistors 12 and 14 are matched devices, they will have the same base-emitter voltage drop thereacross whereby the current $I_O$ will be substantially equal to the current $I_R$. Moreover, because the voltage at node 20 is forced to be substantially equal to the voltage established at node 22 the collector-base voltage drops of the two transistors 12 and 14 will also be equal and will track one another. Thus, the effects of the "Early" voltage errors as well as beta process variations, can be neglected.

Referring now to FIG. 2 current mirror 10 is shown in more detail. It is to be understood that the components in FIG. 2 which correspond to components in FIG. 1 are designated by the same reference numerals. Differential amplifier 18 is illustrated in FIG. 2 comprises a pair of PNP transistors 28 and 30 the emitters of which are differentially connected to current supply 32. The bases of these transistors are coupled respectively to nodes 20 and 22 which correspond to the two inputs of amplifier 18. The collectors of transistors 28 and 30 are coupled to a differential-to-single ended output load comprising diode connected transistor 34 and transistor 36. The differential-to-single ended load circuit is conventional in operation and is well known to those skilled in the art. Current supply 32 provides the "tail" current to the differential amplifier.

In operation, transistor 30 will be rendered conductive to supply the base currents to transistors 12 and 14 thereby turning these devices on until the balanced condition is reached at which transistor 14 sinks the current $I_O$ from the load circuitry coupled to output 26. In the balanced condition transistor 12 is supplied sufficient base current drive from transistor 30 to sink all of the current from supply 16. Transistor 28 is sufficiently turned on by transistor 12 being rendered conductive to, in turn, render diode connected transistor 34 conductive. This turns on transistor 36 such that transistor 30 provides the required base current drive to transistors 12 and 14 as previously described. Any variations in the voltage $V_O$ established at node 22 is forced onto node 20 as aforementioned. Hence, the collector-base voltage drops across transistor 12 and 14 track each other whereby the operation of the current mirror 10 functions in the manner described above with reference to FIG. 1.

Turning now to FIG. 3 there is illustrated current to voltage converter circuit 40 of the present invention which includes current mirror 10 as described above. Converter 40 produces a voltage at output 38 that is representative of the current input supplied at input 42 to the current mirror. It is again to be understood that components of FIG. 3 corresponding to like components shown in FIGS. 1 and 2 are designated by the same reference numerals. Further, current to voltage converter circuit 40 is suited to be fabricated in integrated circuit form using conventional bipolar fabrication processes well known to those skilled in the art of manufacturing integrated circuits. Current mirror 10 is realized by differential amplifier 18 which comprises transistors 12, 14, 28, 30, 34, and 36 as described above. The reference current supply circuit includes a pair of matched PNP transistors 44 and 46 the bases of which are coupled together with the emitter of transistor 48. The emitters of transistors 44 and 46 are returned to power supply conductor 24 via resistors 50 and 52 respectively. A current source coupled with the collector of transistor 44 as well as to the base of transistor 48 sources a predetermined and substantially constant current $I_R$ to ground reference via power supply conductor 56. Multiple collector transistor 46 has two of its collectors coupled via diodes 60 and 62 to nodes 20 and 22, the inputs of differential amplifier 18. A third collector of transistor 46 is connected via lead 58 to supply the tail current required by differential amplifier 18 as described above. The emitter of transistor 12 is coupled to ground reference through series connected resistors 64 and 66. Similarly, the emitter of transistor 14 is coupled to ground reference through series connected resistors 68 and 70 with the interconnection therebetween being connected to input 42. A feedback amplifier comprising NPN transistor 72 and quasi-Darlington connected NPN transistors 74 and 76 provides both the voltage output and a current feedback signal via resistor 78 to the interconnection between resistors 64 and 66, at node 80, of current mirror 10. Resistor 82 provides biasing between transistor 74 and 76 as is well known. The base of transistor 72 is coupled to the anode of diode 60 at which is established a bias potential for the transistor. The input to the feedback amplifier is coupled to the output of current mirror 10 at node 22 and corresponds to the base of transistor 74. Capacitor 84 stabilizes the loop formed between current mirror 10 and the feedback amplifier by placing a pole in the transfer characteristics of converter 40 to prevent oscillations.

In operation, with no current input supplied at input terminal 42, converter 40 will seek a balanced operating state or condition that forces the voltage developed across resistor 66 to be equal to the voltage established across resistor 70 as will now be described. Transistors 44 and 46 are turned on by base current drive sourced through transistor 48 whereby current supply 54 sources a current through transistor 44 substantially equal to the value $I_R$. This current is mirrored through transistor 46 such that bias currents are sourced from the multiple collectors of the transistor to render differential amplifier 18 operative. A bias voltage is therefor developed across diode 60 which enables transistor 72 to be turned on which, in turn, enables transistor 74 and 76 to be rendered conductive. Diode 62, it should be noted, is provided to ensure that current mirror 10 has a balanced configuration. As long as an unbalanced state exists, i.e. the voltage across resistor 66 being less than the voltage established at node 42, transistors 30 and 36 are rendered less conductive than transistors 12 and 28 whereby excess current drive is available to the base of transistor 74. This causes transistor 74 and 76 to conduct which supply a current feedback via resistor 78 to node 80 which raises the voltage developed across resistor 66 until this voltage equals the voltage established across resistor 70. Thereafter, transistors 12 and 14 conduct equally and the current sourced to output 22 of the current mirror 10 is equal to the current sank through transistor 14 plus the base current drive to transistor 74. The operation of the current to voltage converter circuit 40 is then at a quiescent balanced operating condition.

As a current input is supplied to input terminal 42 the voltage developed across resistor 70 and hence the voltage at the emitter of transistor 14 increases. The current mirror will seek a new balanced operating state which will force the voltage developed at node 80 to again equal the voltage established at terminal 42 due to the current input. The current which is required to establish the voltage at node 80 is provided by transistor 76 which flows through resistor 78. Hence, the output voltage developed at output 38 is the sum of the voltages developed across resistors 66 and 78. Thus, the output voltage is proportional to the ratio of resistors 66 and 78 and is a function of the current signal applied at input 42.

Current to voltage converter 40 may be utilized to provide a digital analog conversion. If, for example, multiple current inputs are supplied to input 42 that correspond to individual bits of a digital coded input signal, the analog output voltage produced at output 38 is representive of the digital signal.

Hence, what has been described above, is a novel current to voltage conversion circuit suitable for producing an output voltage that is related to a current input and which is proportional to a resistor ratio.

I claim:

1. A current to voltage conversion circuit, comprising:

current mirror means for sinking a current at an output of a predetermined magnitude when said current mirror means is a quiescent balanced operating state, the value of said current being caused to vary in response to said current mirror means receiving a current input supplied at an input thereof which causes the operation thereof to become unbalanced;

feedback amplifier means responsive to said current mirror means for providing current feedback at an output thereof to force the operation of said current mirror means to a balanced operating condition such that an output voltage is established at said output the magnitude of which varies as a function of said current input; and said current mirror means including:

(a) differential amplifier means having first and second inputs and an output, said first input being coupled to said output of said current mirror means;

(b) current supply means for sourcing currents to said first and second inputs of said differential amplifier means;

(c) a first transistor having first, second and control electrodes, said first electrode being coupled to said input of said current mirror means, said second electrode being coupled to said output of said current mirror means and said control electrode being coupled to said output of said differential amplifier means; and (d) a second transistor having first, second and control electrodes, said first electrode being coupled to said output of said feedback amplifier means, said second electrode being coupled to said second input of said differential amplifier means and said control electrode being coupled to said output of said differential amplifier means.

2. The circuit of claim 1 wherein said current mirror means includes:

first and second resistors series connected between said first electrode of said first transistor and a ground reference potential, said input of said current mirror means being coupled to the interconnection between said first and second resistors; and third and fourth resistors series connected between said first electrode of said second transistor and said ground reference potential, the interconnection between said third and fourth resistors being coupled to said output of said feedback amplifier means.

3. The circuit of claim 2 wherein said feedback amplifier means includes resistive circuit means for coupling said output of said feedback amplifier means to said interconnection of said third and fourth resistors.

4. The circuit of claim 3 wherein said feedback amplifier means includes:

a third transistor having first, second and control electrodes, said second electrode being coupled to a source of operating potential, said control electrode being coupled to said output of said current mirror means; and a fourth transistor having first, second and control electrodes, said first electrode being coupled to said output of said feedback amplifier means, said second electrode being coupled to said source of operating potential and said control electrode being coupled to said first electrode of said third transistor.

5. The circuit of claim 4 wherein said current supply means includes:

a fifth transistor having first, second and control electrodes, said first electrode being coupled to said source of operating potential;

a sixth transistor having first, second, third and control electrodes, said first electrode being coupled to said source of operating potential, said second and third electrodes being coupled respectively to said first and second inputs of said differential amplifier means and said control electrode being coupled to said control electrode of said fifth transistor; and current source means coupled to said second and control electrodes of said fifth transistor for sourcing a reference current therefrom.

6. The circuit of claim 5 wherein said current source means includes:

a seventh transistor having first, second and control electrodes, said first electrode being coupled to said control electrode of said fifth transistor, said second electrode being coupled to said ground reference potential, said control electrode being coupled to said second electrode of said fifth transistor; and a reference current source coupled between said second electrode of said fifth transistor and said ground reference potential.

7. The circuit of claim 6 wherein said current mirror means includes first and second diodes coupled respectively between said second and third electrodes of said sixth transistor and said first and second inputs of said differential amplifier means.

8. The circuit of claim 7 wherein said feedback amplifier means includes an eighth transistor having a first electrode coupled to said second electrode of said third transistor, a second electrode coupled to said source of operating potential and a control electrode coupled to said third electrode of said sixth transistor.

* * * * *